US011083247B2

(12) United States Patent
Li

(10) Patent No.: US 11,083,247 B2
(45) Date of Patent: Aug. 10, 2021

(54) SPORTS SHOE WITH INFLATABLE TIGHTENING SYSTEM

(71) Applicants: Zhejiang Geely Holding Group Co., LTD., Hangzhou (CN); Zhejiang Geely Automobile Research Institute Co., LTD., Taizhou (CN)

(72) Inventor: Shufu Li, Hangzhou (CN)

(73) Assignees: ZHEJIANG GEELY HOLDING GROUP CO., LTD., Hangzhou (CN); ZHEJIANG GEELY AUTOMOBILE RESEARCH INSTITUTE CO., LTD., Taizhou (CN)

( * ) Notice: Subject to any disclaimer, the term of this patent is extended or adjusted under 35 U.S.C. 154(b) by 134 days.

(21) Appl. No.: 16/480,668

(22) PCT Filed: Dec. 18, 2017

(86) PCT No.: PCT/CN2017/116895
§ 371 (c)(1),
(2) Date: Jul. 24, 2019

(87) PCT Pub. No.: WO2018/137440
PCT Pub. Date: Aug. 2, 2018

(65) Prior Publication Data

US 2021/0127788 A1 May 6, 2021

(30) Foreign Application Priority Data

Jan. 24, 2017 (CN) ..... 201710054976.0

(51) Int. Cl.
*A43B 13/20* (2006.01)
*A43B 23/02* (2006.01)
(Continued)

(52) U.S. Cl.
CPC ..... *A43B 23/029* (2013.01); *A43B 5/00* (2013.01); *A43B 13/20* (2013.01); *A43B 13/203* (2013.01); *A43B 17/035* (2013.01)

(58) Field of Classification Search
CPC ..... A43B 23/028; A43B 23/029; A43B 13/20; A43B 17/03; A43B 17/035; A43B 13/203
(Continued)

(56) References Cited

U.S. PATENT DOCUMENTS 850,327 A * 4/1907 Tauber ..... A43B 13/20 36/29
4,991,317 A * 2/1991 Lakic ..... A41D 19/001 36/29

(Continued)

FOREIGN PATENT DOCUMENTS

CN 2337805 Y 9/1999
CN 2396670 Y 9/2000

(Continued)

*Primary Examiner* — Marie D Bays
(74) *Attorney, Agent, or Firm* — Cheng-Ju Chiang

(57) ABSTRACT

A sports shoe includes a bottom sole and an upper vamp attached to the bottom sole. The bottom sole is provided with a compressible and stretchable air cushion. The upper vamp is provided with at least one airbag configured for covering and abutting against the foot. An air-charging valve is provided between the air cushion and the airbag. An air-intaking valve is provided between the air cushion and the external environment. An air-discharging duct is provided between the airbag and the external environment. The air-discharging duct is provided with an air-discharging valve. When the sports shoe is taken on the foot, the air cushion is used to inflate the airbag of the upper vamp automatically. After being inflated, the airbag surrounds the foot to cause the upper vamp of the shoe to fit well with the foot, to improve wearing comfort of the shoe.

14 Claims, 3 Drawing Sheets

(51) Int. Cl.
*A43B 5/00* (2006.01)
*A43B 17/03* (2006.01)

(58) Field of Classification Search
USPC ..... 36/29
See application file for complete search history.

(56) References Cited

U.S. PATENT DOCUMENTS 4,999,932 A * 3/1991 Grim ..... A43B 7/081 36/114
5,025,575 A * 6/1991 Lakic ..... A41D 19/001 36/44
5,353,525 A 10/1994 Grim
5,392,534 A 2/1995 Grim
5,846,063 A * 12/1998 Lakic ..... A42B 3/122 417/440
5,893,219 A 4/1999 Smith et al.
6,014,823 A * 1/2000 Lakic ..... A41D 19/01523 36/11.5
6,409,486 B1 * 6/2002 Baek ..... A43B 5/0407 251/321
6,463,679 B1 * 10/2002 Buttigieg ..... A43B 13/203 36/29
7,478,488 B1 * 1/2009 Davis ..... A43B 7/081 36/29
8,677,652 B2 * 3/2014 Marvin ..... A43B 7/084 36/45
2004/0003517 A1 * 1/2004 Marvin ..... A43B 13/186 36/93
2004/0010939 A1 * 1/2004 Liu ..... A43B 7/081 36/29
2005/0028404 A1 * 2/2005 Marvin ..... A43B 13/203 36/45
2006/0032089 A1 * 2/2006 Lo ..... A43B 13/206 36/29
2006/0196081 A1 * 9/2006 Lee ..... A43B 13/203 36/29
2010/0199518 A1 * 8/2010 Buttigieg ..... A43B 13/203 36/29
2011/0067264 A1 3/2011 Doyle
2018/0255865 A1 * 9/2018 Hsu ..... A43B 7/085

FOREIGN PATENT DOCUMENTS

CN 2627868 Y 7/2004
CN 2703434 Y 6/2005
CN 201097691 Y 8/2008
CN 102894540 A 1/2013
CN 103431574 A 12/2013
CN 103783731 A 5/2014
CN 204104979 U 1/2015
CN 205597252 U 9/2016
CN 106993841 A 8/2017
JP 2005-532115 A 10/2005

* cited by examiner

SPORTS SHOE WITH INFLATABLE TIGHTENING SYSTEM

CROSS-REFERENCE TO RELATED APPLICATION

The present application is a 35 U.S.C. §371 National Phase conversion of International (PCT) Patent Application No. PCT/CN2017/116895, filed on Dec. 18, 2017 which is based on and claims the priority of Chinese patent application No. 201710054976.0, filed on Jan. 24, 2017. The entire disclosure of the above-identified application is incorporated herein by reference.

TECHNICAL FIELD

The present application relates to shoes, and more particularly to a sports shoe with an inflatable tightening system.

BACKGROUND ART

With the improvement of people's living standards, more and more people begin to pay attention to their health and exercises. As one of the most popular exercises, running is gradually changing people's daily leisure life. However, running may bring harm to one's knees or ankles. In order to avoid sports injuries during running or walking, e.g., injuries to the knees or ankles, it is important to choose a sports shoe with proper size.

Technical Problem

Usually, a sports shoe is fastened on foot by shoelaces or Velcro. However, the shoelaces or Velcro requires to be operated by hands, which is inconvenient during fastening the vamp of the sports shoe. In addition, by using the shoelaces or Velcro, the vamp does not fit well with the foot, thereby reducing the comfort of the shoe. Since the shoelaces or Velcro is prone to be loosened, the shoe may be disengaged from one's foot during exercises, which may cause happening of sports injuries.

Technical Solution

In view of the above, it is necessary to provide a sports shoe with an inflatable tightening system, to solve the problem that the existing sports shoe is not comfortable and may incur sports injuries because the vamp does not fit well with the foot.

In an embodiment of the present application, a sports shoe with an inflatable tightening system includes a bottom sole and an upper vamp attached to the bottom sole. The bottom sole is provided with a compressible and stretchable air cushion. The upper vamp is provided with at least one airbag configured for covering and abutting against the foot. An air-charging valve is provided between the air cushion and the at least one airbag. An air-intaking valve is provided between the air cushion and the external environment. An air-discharging duct is provided between the at least one airbag and the external environment. The air-discharging duct is provided with an air-discharging valve. When the air cushion is compressed, the air-charging valve is opened and the air-intaking valve is closed, such that the air inside the air cushion is filled into the at least one airbag; when the air cushion stretches and restores, the air-intaking valve is opened and the air-charging valve is closed, such that the air in the external environment enters into the air cushion; when the air-discharging valve is activated to open, the air inside the at least one airbag is discharged out via the air-discharging duct; when the air-discharging valve is closed, the air inside the at least one airbag is prevented from being discharged out via the air-discharging duct.

Further, an air-charging channel is connected between the air cushion and the at least one airbag, and the air-charging valve is disposed in the air-charging channel.

Further, an air-intaking channel is connected between the air cushion and the external environment, and the air-intaking valve is disposed in the air-intaking channel.

Further, the air-discharging valve is disposed in the air-discharging duct.

Further, a first end of the air-discharging duct is communicated with the at least one airbag, a second end of the air-discharging duct extends to a side surface of the bottom sole, and the air-discharging valve is disposed adjacent to the second end of the air-discharging duct.

Further, the air-intaking valve and the air-discharging valve are integrated into one valve assembly.

Further, the air-discharging valve is connected with an air-discharging button, the air-discharging button drives the air-discharging valve to open when the air-discharging button is activated.

Further, the air-discharging button is disposed at a side surface of the bottom sole, and the air-discharging button is exposed.

Further, the air-discharging duct is a hose made of a soft material.

Further, air-discharging duct is partially received in the air cushion, and the air-discharging duct passes through the air cushion to communicate with the at least one airbag.

Further, the air-discharging duct is L-shaped and includes a vertical section and a horizontal section connecting with the vertical section, the vertical section is communicated with the at least one airbag, and the horizontal section extends to the side surface of the bottom sole.

Further, a fixing hole is provided between the air cushion and the at least one airbag, the vertical section of the air-discharging duct is fixed and sealed in the fixing hole.

Further, the air-discharging duct is embedded in a sidewall of the upper vamp.

Further, the at least one airbag has more than one, the multiple airbags are distributed over the upper vamp, and the multiple airbags are communicated with each other.

Further, the at least one airbag includes at least one of a front airbag adapted for covering a front part of the foot, a side airbag adapted for covering a side part of the foot, a bottom airbag adapted for covering a heel part of the foot, and a top airbag adapted for covering an ankle part of the foot.

Further, the air cushion is formed in the bottom sole and located corresponding to the heel part of one's foot.

Further, when the air pressure in the air cushion is greater than the air pressure in the at least one airbag, the air-charging valve is opened; when the air pressure in the at least one airbag is greater than the air pressure in the air cushion, the air-charging valve is closed; when the air pressure in the air cushion is greater than the air pressure in the external environment, the air-intaking valve is closed; when the air pressure in the external environment is greater than the air pressure in the air cushion, the air-intaking valve is opened.

Further, when the air pressure in the at least one airbag is greater than the air pressure in the external environment, the air-discharging valve is closed.

Advantageous Effects

The sports shoe with inflatable tightening system according to the embodiment of the present application has the following advantages: when the sports shoe is taken on the foot, the air cushion is used to inflate the airbag of the upper vamp automatically. After being inflated, the airbag surrounds the foot to cause the upper vamp of the shoe to fit well with the foot, to thereby improve wearing comfort of the shoe and solve the problem that the existing sports shoe is not comfortable and may incur sports injuries because the upper vamp does not fit well with the foot.

MODE FOR INVENTION

Figure 1:
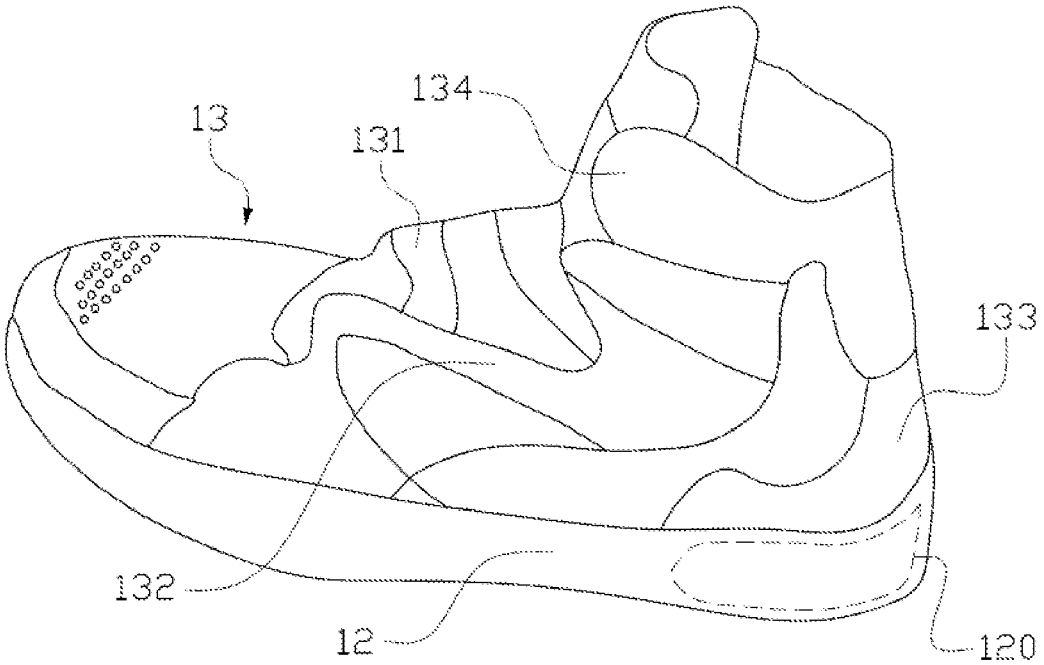
FIG. 1 is an isometric view of a sports shoe according to a first embodiment of the present application.

In order to make the purposes, characteristics, and advantages of the present application more apparently, embodiments of the present application will now be described in more detail with reference to the drawing figures.

First Embodiment

Figure 2:
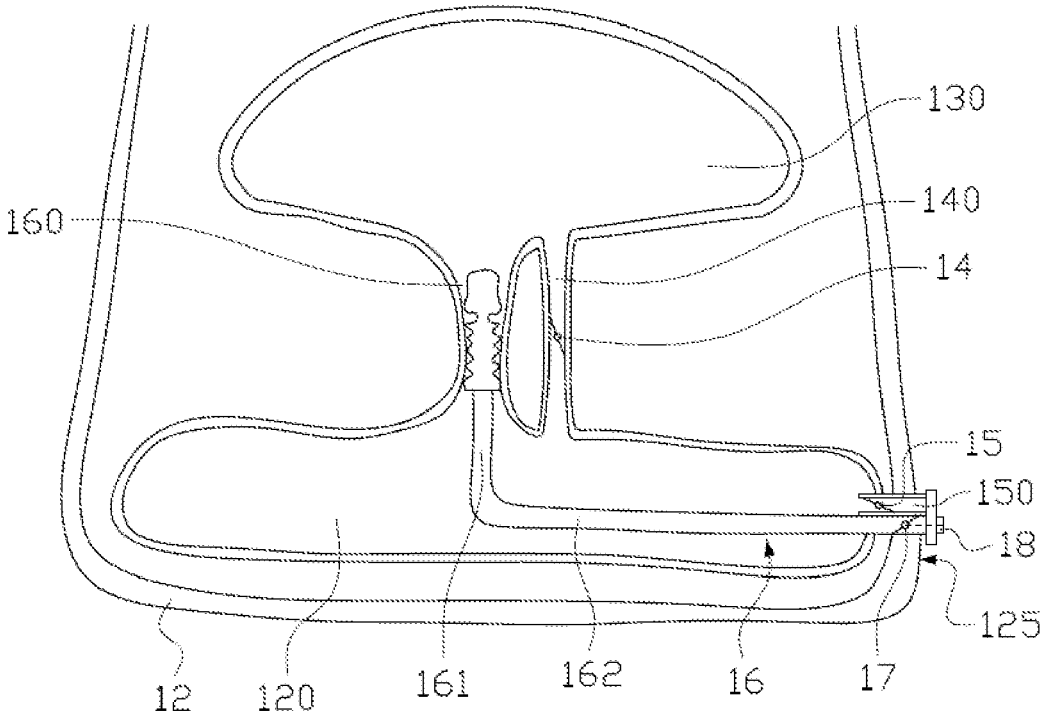
FIG. 2 is a schematic view of an inflatable tightening system of the sports shoe of FIG. 1.

FIG. 1 is an isometric view of a sports shoe according to a first embodiment of the present application. FIG. 2 is a schematic view of an inflatable tightening system of the sports shoe of FIG. 1. Referring to FIGS. 1-2, the sports shoe with the inflatable tightening system includes a bottom sole 12 and an upper vamp 13 attached to the bottom sole 12. The bottom sole 12 is provided with an air cushion 120 which is compressible and stretchable. The upper vamp 13 is provided with at least one airbag 130 for covering and abutting against the foot. An air-charging valve 14 is provided between the air cushion 120 and the airbag 130. An air-intaking valve 15 is provided between the air cushion 120 and the external environment. An air-discharging duct 16 is connected between the airbag 130 and the external environment. The air-discharging duct 16 is provided with an air-discharging valve 17.

The air cushion 120 is formed in the bottom sole 12 and located corresponding to the heel part of one's foot. As a person puts his foot into the upper vamp 13 and the heel part of the foot stamps on the air cushion 120, the air cushion 120 inflates the airbag 130 by using the air-charging valve 14 and the air-intaking valve 15. In detail, when the air cushion 120 is compressed, the air-charging valve 14 is opened and the air-intaking valve 15 is closed, such that the air inside the air cushion 120 is filled into the airbag 130; when the air cushion 120 stretches and restores, the air-intaking valve 15 is opened and the air-charging valve 14 is closed, such that the air in the external environment enters into the air cushion 120; when the air-discharging valve 17 is activated to open, the air inside the airbag 130 is discharged out via the air-discharging duct 16; when the air-discharging valve 17 is closed, the air inside the airbag 130 is prevented from being discharged out via the air-discharging duct 16.

Figure 3:
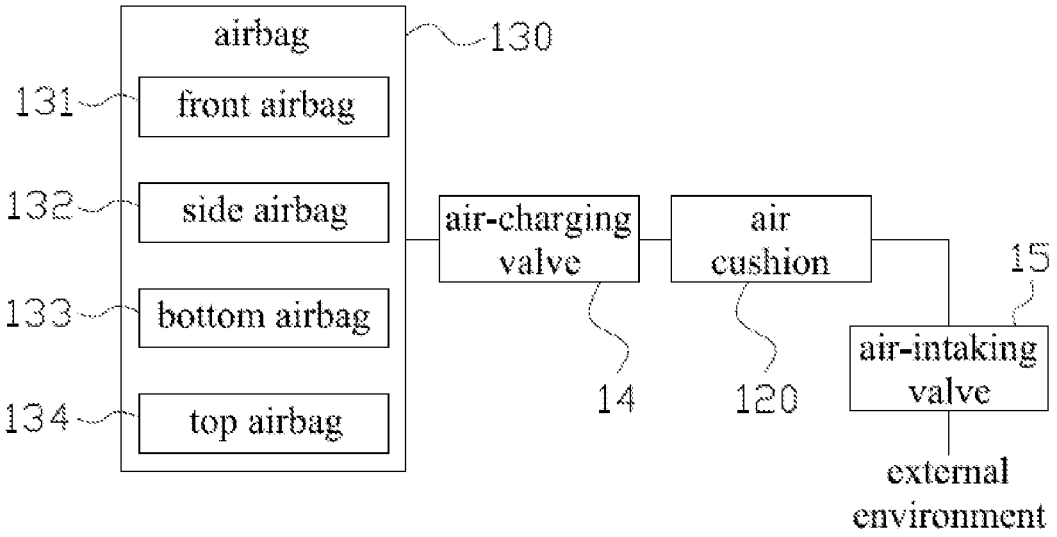
FIG. 3 is a schematic diagram showing the inflatable tightening system of FIG. 2 when it is inflated.
Figure 4:
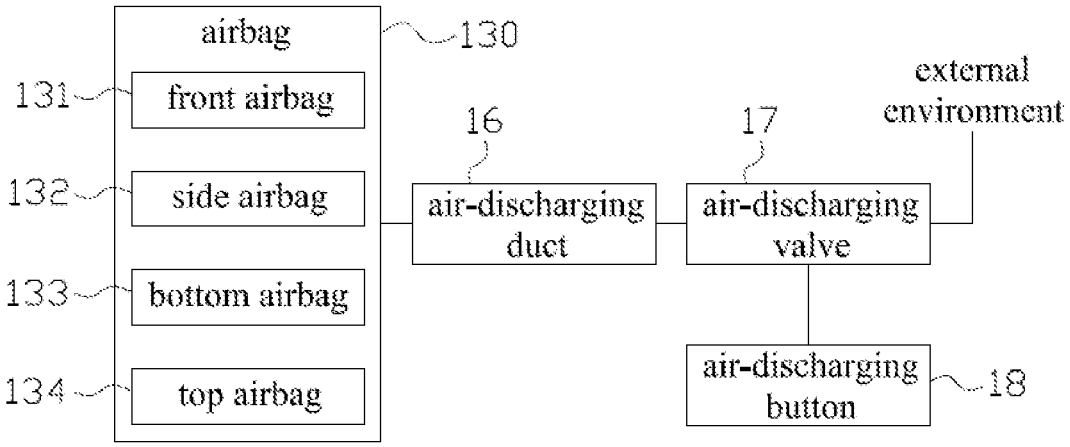
FIG. 4 is a schematic diagram showing the inflatable tightening system of FIG. 2 when it is deflated.

FIG. 3 is a schematic diagram showing the inflatable tightening system of FIG. 2 when it is inflated. FIG. 4 is a schematic diagram showing the inflatable tightening system of FIG. 2 when it is deflated. Referring to FIGS. 1-4, when the foot stamps on the air cushion 120 to cause the air cushion 120 to compress, the air-charging valve 14 is opened and the air-intaking valve 15 is closed, such that the air inside the air cushion 120 is pushed into the airbag 130 to inflate the airbag 130; when the foot is raised up to cause the air cushion 120 to be released, the air-intaking valve 15 is opened and the air-charging valve 14 is closed, such that the air in the external environment is supplied into the air cushion 120, to cause the air cushion 120 to stretch and restore back to the original state before being stamped on. As the person walks, the foot stamps on the air cushion 120 repeatedly to cause the airbag 130 to be inflated continually, until the airbag 130 is inflated to a state in which the upper vamp 13 fits well with the foot. That is, when the air pressure in the airbag 130 reaches a certain value, the air-charging valve 14 is closed and no longer opens, the air cushion 120 stops to inflate the airbag 130. Thereafter, the air cushion 120 is used as a buffer for the shoe.

Specifically, when the air pressure in the air cushion 120 is greater than the air pressure in the airbag 130, the air-charging valve 14 is opened; when the air pressure in the airbag 130 is greater than the air pressure in the air cushion 120, the air-charging valve 14 is closed; when the air pressure in the air cushion 120 is greater than the air pressure in the external environment, the air-intaking valve 15 is closed; when the air pressure in the external environment is greater than the air pressure in the air cushion 120, the air-intaking valve 15 is opened. In addition, when the air pressure in the airbag 130 is greater than the air pressure in the external environment, the air-discharging valve 17 is closed.

The air pressure closing the air-charging valve 14 can be determined according to the size or the type (e.g., for men's, women's, children) of the shoe. When the air pressure in the airbag 130 reaches the determined value, the air-charging valve 14 is closed and no longer opens.

An air-charging channel 140 is connected between the air cushion 120 and the airbag 130, and the air-charging valve 14 is disposed in the air-charging channel 140. When the air-charging valve 14 is opened, the air inside the air cushion 120 is filled into the airbag 130 via the air-charging channel 140; when the air-charging valve 14 is closed, the air in the airbag 130 cannot flow back to the air cushion 120 via the air-charging channel 140.

An air-intaking channel 150 is connected between the air cushion 120 and the external environment, and the air-intaking valve 15 is disposed in the air-intaking channel 150. When the air-intaking valve 15 is opened, the air in the external environment is supplied into the air cushion 120 so that the air cushion 120 restores; when the air-intaking valve 15 is closed, the air inside the air cushion 120 cannot flow towards the external environment via the air-intaking channel 150.

The air-discharging valve 17 is disposed in the air-discharging duct 16. In the embodiment, a first end of the air-discharging duct 16 is communicated with the airbag 130, and a second end of the air-discharging duct 16 extends to a side surface 125 of the bottom sole 12. The air-discharging valve 17 is disposed adjacent to the second end of the air-discharging duct 16. In order to save layout space, the air-intaking valve 15 and the air-discharging valve 17 may be integrated into one valve assembly. The air-intaking valve 15 is used to control the air in the external environment to enter into the air cushion 120, while the air-discharging valve 17 is used to control the air in the airbag 130 to be discharged out towards the external environment via the air-discharging duct 16.

In order to facilitate the air in the airbag 130 to discharge out when the person takes off the shoe, the air-discharging valve 17 is connected with an air-discharging button 18. When the air-discharging button 18 is activated, the air-discharging button 18 is used to drive the air-discharging valve 17 to open, such that the air in the airbag 130 can be discharged out via the air-discharging duct 16. Specifically, the air-discharging button 18 is disposed at the side surface 125 of the bottom sole 12, and the air-discharging button 18 is exposed. Because the air-discharging button 18 is disposed at the side surface 125 of the bottom sole 12, the air-discharging button 18 is prevented from being activated unintentionally by external objects to cause the airbag 130 to deflate; when taking off the shoe, the person needs only placing the two shoes worn by him towards each other and using the air-discharging button 18 of one shoe to activate the air-discharging button 18 of the other shoe. Due to the mutual activation of the two air-discharging buttons 18 of the two shoes, the air-discharging valves 17 of the two shoes are driven to be opened simultaneously, such that the air inside the airbag 130 of each shoe is discharged out via the air-discharging duct 16, the air pressure inside the airbag 130 is lowered down, the upper vamp 13 of each shoe begins to loosen with respect to the foot, such that the person can finally take off the shoe. Thus, due to the existence of the air-discharging button 18, the person does not have to stoop down to touch the air-discharging button 18 with his hand in order to open the air-discharging valve 17.

Preferably, the air-discharging duct 16 is a hose made of a soft material. In the embodiment, the air-discharging duct 16 is partially received in the air cushion 120, and the air-discharging duct 16 passes through the air cushion 120 to communicate with the airbag 130. Particularly, the air-discharging duct 16 is L-shaped, including a vertical section 161 and a horizontal section 162 connecting with the vertical section 161. The vertical section 161 is communicated with the airbag 130, and the horizontal section 162 extends to the side surface 125 of the bottom sole 12. A fixing hole 160 is provided between the air cushion 120 and the airbag 130, the vertical section 161 of the air-discharging duct 16 is fixed and sealed in the fixing hole 160, such that the air inside the air cushion 120 cannot flow to the airbag 130 via the fixing hole 160, and the air inside the airbag 130 cannot flow to the air cushion 120 via the fixing hole 160.

In each shoe, there can be one or more airbag 130. For example, the airbag 130 may include a front airbag 131 adapted for covering a front part of the foot, a side airbag 132 adapted for covering a side part of the foot, a bottom airbag 133 adapted for covering a heel part of the foot, and a top airbag 134 adapted for covering an ankle part of the foot. Each shoe may include at least one of these airbags. When multiple (i.e., more than one) airbags 130 are provided, the multiple airbags 130 are distributed over the upper vamp 13, and the multiple airbags 130 are communicated with each other. In the embodiment, multiple airbags including a front airbag 131, a side airbag 132, a bottom airbag 133 and a top airbag 134 are provided at different locations for each shoe, such that the foot is fully surrounded by the multiple airbags 130, to thereby protect the critical areas of the foot from sports injuries.

Second Embodiment

Figure 5:
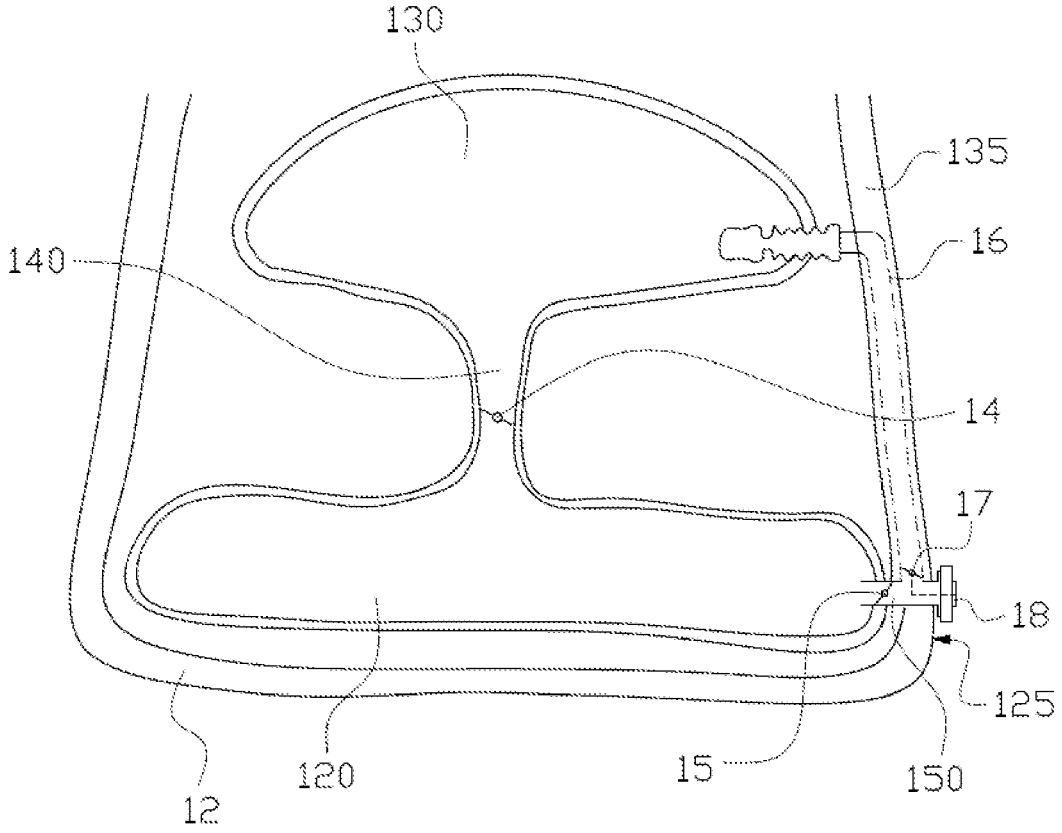
FIG. 5 is an isometric view of a sports shoe according to a second embodiment of the present application.

FIG. 5 is an isometric view of a sports shoe according to a second embodiment of the present application. Referring to FIG. 5, the difference between this embodiment and the above-mentioned first embodiment mainly lies in that, the air-discharging duct 16 is embedded in a sidewall 135 of the upper vamp 13, such that the air-discharging duct 16 does not have to pass through the air cushion 120, it is not required to define a fixing hole 160 between the air cushion 120 and the airbag 130 for fixing the air-discharging duct 16, and it is also not required to think about the sealing problem between the air-discharging duct 16 and the air cushion 120. Therefore, this embodiment has a simpler structure. Other structures and the working principle of this embodiment can refer to the first embodiment, and are omitted herein for clarity.

The sports shoe with inflatable tightening system according to the embodiment of the present application has the following advantages: when the sports shoe is taken on the foot, the air cushion is used to inflate the airbag of the upper vamp automatically. After being inflated, the airbag surrounds the foot to cause the upper vamp of the shoe to fit well with the foot, to thereby improve wearing comfort of the shoe and solve the problem that the existing sports shoe is not comfortable and may incur sports injuries because the upper vamp does not fit well with the foot.

The above are embodiments of the present application only, and should not be deemed as limitations to the present application. Although the present application has been disclosed in embodiments as above, it is not intended to limit the present application. It should be noted that variations and improvements will become apparent to those skilled in the art to which the present application pertains. Therefore, the scope of the present application is defined by the appended claims.

INDUSTRIAL APPLICABILITY

The sports shoe with inflatable tightening system according to the embodiment of the present application has the following advantages: when the sports shoe is taken on the foot, the air cushion is used to inflate the airbag of the upper vamp automatically. After being inflated, the airbag surrounds the foot to cause the upper vamp of the shoe to fit well with the foot, to thereby improve wearing comfort of the shoe and solve the problem that the existing sports shoe is not comfortable and may incur sports injuries because the upper vamp does not fit well with the foot.

What is claimed is:

1. A sports shoe with an inflatable tightening system, comprising:

a bottom sole being provided with a compressible and stretchable air cushion;

an upper vamp being attached to the bottom sole, the upper vamp being provided with at least one airbag configured for covering and abutting against the foot;

an air-charging valve being provided between the air cushion and the at least one airbag;

an air-intaking valve being provided between the air cushion and an external environment; and an air-discharging duct being provided between the at least one airbag and the external environment, the air-discharging duct being provided with an air-discharging valve, and the air-discharging duct is partially received in the air cushion, and the air-discharging duct passes through the air cushion to communicate with the at least one airbag;

wherein when the air cushion is compressed, the air-charging valve is opened and the air-intaking valve is closed, such that the air inside the air cushion is filled into the at least one airbag;

when the air cushion stretches and restores, the air-intaking valve is opened and the air-charging valve is closed, such that the air in the external environment enters into the air cushion;

when the air-discharging valve is activated to open, the air inside the at least one airbag is discharged out via the air-discharging duct;

when the air-discharging valve is closed, the air inside the at least one airbag is prevented from being discharged out via the air-discharging duct.

2. The sports shoe of claim 1, wherein an air-charging channel is connected between the air cushion and the at least one airbag, and the air-charging valve is disposed in the air-charging channel.

3. The sports shoe of claim 1, wherein an air-intaking channel is connected between the air cushion and the external environment, and the air-intaking valve is disposed in the air-intaking channel.

4. The sports shoe of claim 1, wherein the air-discharging valve is disposed in the air-discharging duct.

5. The sports shoe of claim 4, wherein a first end of the air-discharging duct is communicated with the at least one airbag, a second end of the air-discharging duct extends to a side surface of the bottom sole, the side surface corresponds to an inner side of the foot, and the air-discharging valve is disposed adjacent to the second end of the air-discharging duct.

6. The sports shoe of claim 5, wherein the air-intaking valve and the air-discharging valve are integrated into one valve assembly.

7. The sports shoe of claim 1, wherein the air-discharging valve is connected with an air air-discharging button, the air-discharging button drives the air-discharging valve to open when the air-discharging button is activated.

8. The sports shoe of claim 7, wherein the air-discharging button is disposed at a side surface of the bottom sole, the side surface corresponds to an inner side of the foot, and the air-discharging button is exposed outside the side surface.

9. The sports shoe of claim 1, wherein the air-discharging duct is a hose made of a soft material.

10. The sports shoe of claim 1, wherein the air-discharging duct is L-shaped and includes a vertical section and a horizontal section connecting with the vertical section, the vertical section is communicated with the at least one airbag, and the horizontal section extends to the side surface of the bottom sole.

11. The sports shoe of claim 10, wherein a fixing hole is provided between the air cushion and the at least one airbag, the vertical section of the air-discharging duct is fixed and sealed in the fixing hole.

12. The sports shoe of claim 1, wherein the at least one airbag has multiple airbags, the multiple airbags are distributed over the upper vamp, and the multiple airbags are communicated with each other.

13. The sports shoe of claim 1, wherein the at least one airbag includes at least one of a front airbag adapted for covering a front part of the foot, a side airbag adapted for covering a side part of the foot, a bottom airbag adapted for covering a heel part of the foot, and a top airbag adapted for covering an ankle part of the foot.

14. The sports shoe of claim 1, wherein the air cushion is formed in the bottom sole and located corresponding to a heel part of one's foot.

* * * * *